United States Patent [19]

Zandel

[11] Patent Number: 4,633,700

[45] Date of Patent: Jan. 6, 1987

[54] CROSSHEAD TIES AND CLEARANCE HOLES ARRANGEMENT FOR EASY REMOVAL OF SAID TIES WITHOUT DISMANTLING OF ENTIRE CROSSHEAD

[75] Inventor: Adam Zandel, Forest Hills, N.Y.

[73] Assignee: Press Technology Corporation, White Plains, N.Y.

[21] Appl. No.: 820,112

[22] Filed: Jan. 21, 1986

[51] Int. Cl.[4] ..... B21D 37/12; B21J 13/04

[52] U.S. Cl. ..... 72/455; 72/453.09; 100/214; 52/227

[58] Field of Search ..... 72/455, 456, 453.09; 100/214, 228, 269 R, 295, 918; 52/227

[56] References Cited

U.S. PATENT DOCUMENTS

| | | | |
|---|---|---|---|
| 3,295,286 | 1/1967 | Schaich | 52/227 |
| 3,418,923 | 12/1968 | Zeitlin et al. | 72/455 |
| 3,479,856 | 11/1969 | Boggio et al. | 72/455 |
| 3,545,372 | 12/1970 | Mueller | 72/455 |

FOREIGN PATENT DOCUMENTS

| | | | |
|---|---|---|---|
| 2114343 | 10/1972 | Fed. Rep. of Germany | 72/455 |
| 1275302 | 5/1972 | United Kingdom | 72/455 |

*Primary Examiner*—Francis S. Husar
*Assistant Examiner*—David B. Jones
*Attorney, Agent, or Firm*—Ostrolenk, Faber, Gerb & Soffen

[57] ABSTRACT

Crosshead and tie-rod assemblies, from which a frame for a forging press is constructed, include several sections each of which is comprised of a plurality of overlapping plates which are held together by ties. Auxiliary clearance holes are provided in the outermost sections through which the ties of the intermediate sections can be removed. Alternatively, the ties which hold together the intermediate middle sections are coaxially aligned with the ties in the outer sections. However, to permit withdrawal of the ties from the middle section without dismantling the outer sections, hollow tubular ties are employed in the outer sections and the solid ties of the middle sections can be removed by guiding them through the tubular ties.

15 Claims, 4 Drawing Figures

CROSSHEAD TIES AND CLEARANCE HOLES ARRANGEMENT FOR EASY REMOVAL OF SAID TIES WITHOUT DISMANTLING OF ENTIRE CROSSHEAD

BACKGROUND OF THE INVENTION

The present invention relates to large forging presses and more particularly to a clearance holes arrangement for a crosshead assembly which is part of a frame structure for the forging press.

The present application is closely related to the subject matter described in patent application U.S. Ser. No. 821,790 entitled "FORGING PRESS WITH ADJUSTABLE DAY-LIGHT AND WITH YOKE DESIGN FOR ATTACHING TIE-RODS TO CROSSHEADS" which is commonly assigned with the present application.

As is known and by way of background, forging presses are used for shaping metal slabs or ingots into and products of desired shape by pressing the metal slab between a pair of dies to give it its shape.

Structurally, the forging press includes a very large steel frame which surrounds a stationary bridge or platform on which a workpiece is placed. In a particular type of forging press known as a pull-down press the frame is movable up and down relative to the stationary bridge. The frame is rectangularly shaped and as large as a high rise building. The horizontally extending members of the frame include an upper crosshead which extends transversely to the stationary bridge and a lower crosshead extending below the bridge and coextensively with the upper crosshead assembly. Vertically extending tie-rod assemblies on either side of the bridge connect the upper crosshead and the lower crosshead to one another to complete the frame. The upper crosshead of the frame is used for squeezing a workpiece between the frame and the stationary bridge. Very power hydraulic jacks located on the lower crosshead and braced against the bottom of the bridge are operable to push the lower crosshead assembly downwardly and thereby produce enormous compressive forces on the workpiece which is placed on the upper surface of the stationary bridge, directly below the upper crosshead.

Each one of the crosshead assemblies consists of several horizontally spaced sections each of which includes a number of vertically oriented plates which are tied together across their thickness to form single units or subassemblies.

The plates of any given subassembly are held together. and reinforced by several rows of horizontally arranged ties which pass through appropriate holes in the plates. Ties can be withdrawn from the unobstructed outermost subassemblies without hindrance to permit dismantling or servicing of those crosshead subassemblies.

However, the ties which hold together intermediate sections of a crosshead assembly cannot be withdrawn unless the outer sections of the crosshead assembly are dismantled first. This is quite disadvantageous because servicing or repair of intermediate crosshead subassemblies is required at times and dismantling of the outer subassemblies for this purpose is very costly, timewise and monetarily. Each crosshead plate weighs several tons and several days may be lost due to this extra unnecessary task.

SUMMARY OF THE INVENTION

Accordingly, it is an object of the present invention to provide a more efficiently serviceable crosshead assembly.

It is another object of the present invention to provide a crosshead assembly in which plates of intermediate sections of the crosshead can be serviced and maintained without dismantling or removal of outer sections of the crosshead assembly.

The foregoing and other objects of the present invention are achieved with the crosshead assembly of the general type described above in which for easy removal of ties from the intermediate sections there are provided an extra set of clearance holes in the outer crosshead assemblies which holes are axially aligned with the ties of the intermediate crosshead sections. Thus, the intermediate ties can be removed and guided through the extra clearance holes in the outer crosshead assembly sections for easy dismantling of intermediate sections of the crosshead assembly.

Where there is a single intermediate crosshead section the extra clearance holes can be divided between the two outer crosshead sections so that, for example, one half of the intermediate ties can be withdrawn through one outer crosshead section while the remainder of the ties will be withdrawn through the other outer crosshead section.

In case there are two intermediate crosshead sections or subassemblies the ties of each intermediate crosshead section will be withdrawn through clearance holes located in the outer subassembly located adjacent thereto.

In a second embodiment the ties in both the intermediate crosshead sections and in the outer crosshead sections are aligned with one another. However, tubular ties are used in the outer crosshead sections which tubular ties have an axial tubular opening which is large enough to permit solid ties which are used in the intermediate section to pass therethrough. it is preferable to leave an annular clearance of between one quarter to one half inches between the interior wall of the tubular ties and the outer diameter of the solid ties.

Other features and advantages of the present invention will become apparent from the following description of preferred embodiments thereof which are described below in relation to the appended drawings.

DETAILED DESCRIPTION OF THE INVENTION

Figure 1:
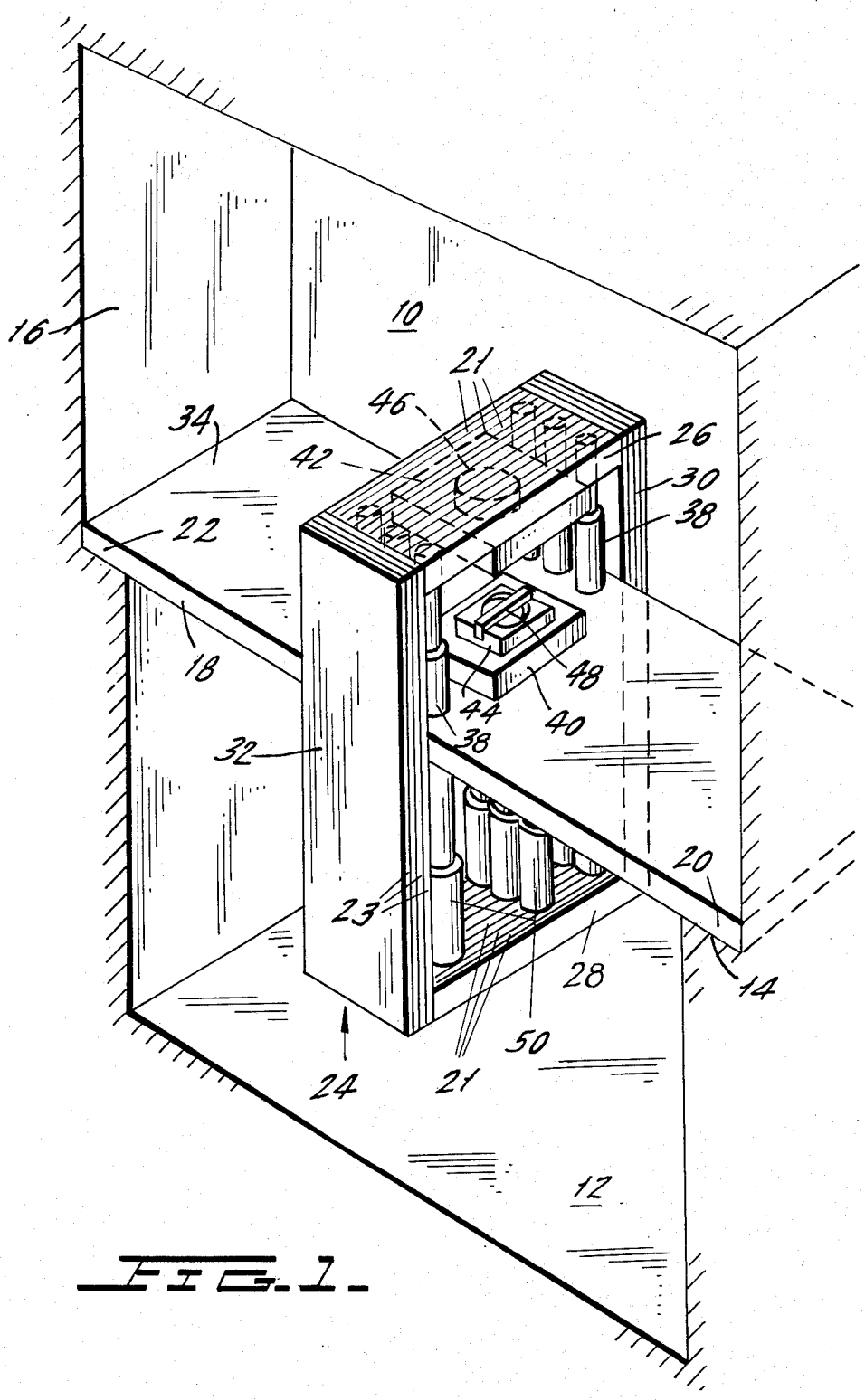
FIG. 1 is a perspective of a schematically illustrated pull-down forging press.
Figure 2:
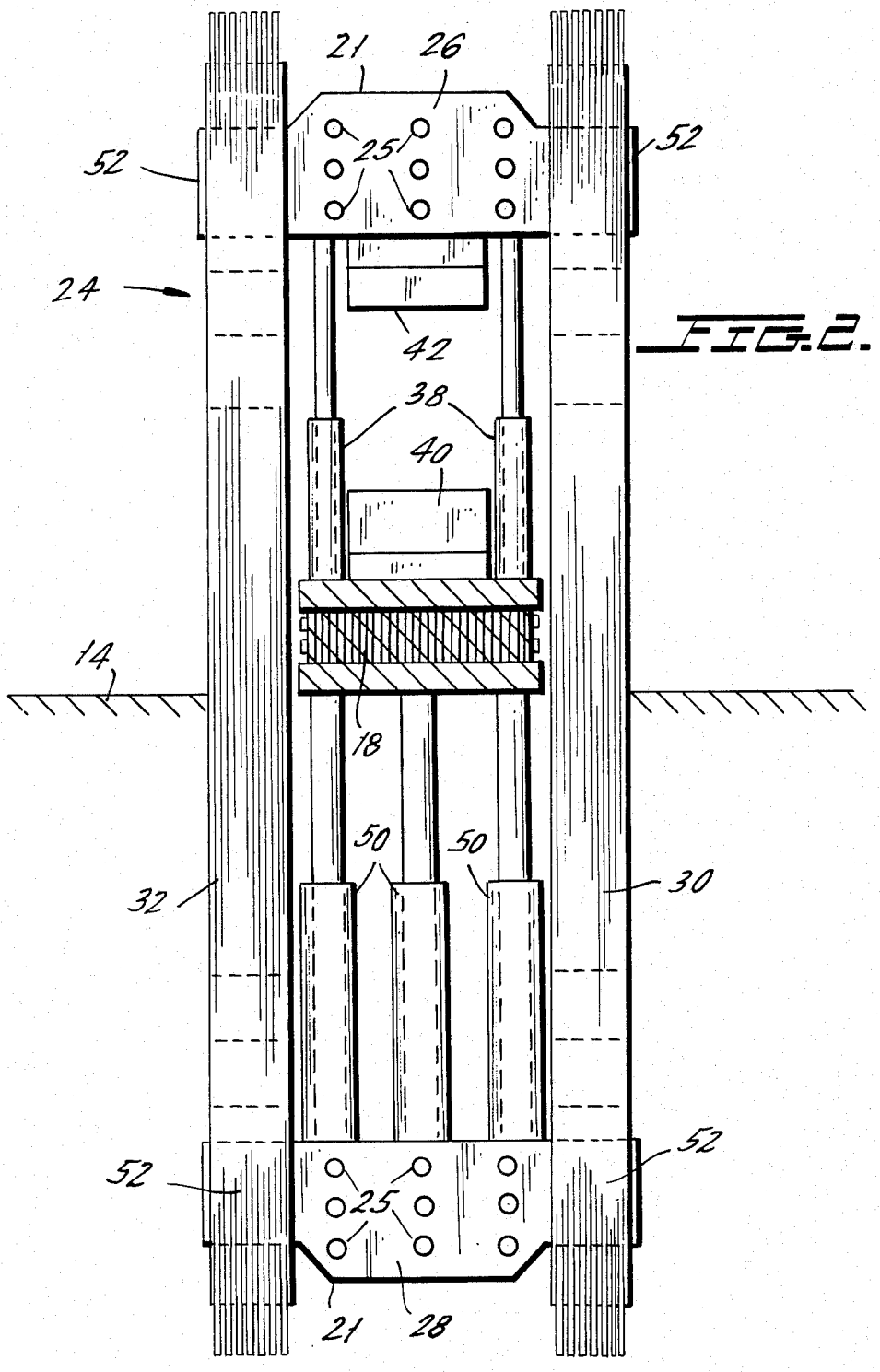
FIG. 2 is a section through FIG. 1 along line 2—2.

FIGS. 1 and 2 illustrate schematically major components of a pull-down forging press. It should be understood that FIGS. 1 and 2 are schematic drawings which are presented for facilitating understanding of the general environment of the present invention. Therefore, these figures are not strictly consistent with one another nor with actual embodiments of the present invention to be described later herein.

Referring first to FIG. 1, a forging press 10 there illustrated is housed in a building structure for a forging press having a foundation pit 12 below ground level 14 and a main building 16 above ground level. A bridge or platform 18 extends across the foundation pit 12 and is supported at its ends 20 and 22 by the building structure or by appropriate support components at about ground level.

A frame 24 surrounds bridge 18 and includes an upper crosshead assembly 26 above the bridge, a lower crosshead assembly 28 located below the bridge and first and second tie-rod assemblies 30 and 32, for connecting the upper and lower crosshead assemblies 26 and 28 to one another to complete the frame 24. Frame 24 is movable up and down in a manner which permits the upper crosshead assembly 26 to be raised and lowered with respect to the top 34 of bridge 18.

A plurality of return cylinders 38 extend between the top 34 of bridge 18 and upper crosshead assembly 26 for supporting the upper crosshead assembly 26 above a workpiece platen 40 which is located on bridge 18. An upper platen 42 is secured to the upper crosshead assembly 26 and projects above workpiece platen 40. An upward facing bottom die 44 and a downward facing top die 46 are respectively secured to workpiece platen 40 and upper platen 42. A metal ingot or slab 48 is placed between dies 44 and 46 to be compressed therebetween to form an end product of a predefined shape.

The metal ingot or slab 48 is given the shape of an end product when the pressure in return cylinders 38 is relaxed and top die 46 is brought to bear against metal ingot 48 upon lowering of frame 24. To provide the necessary forging forces, a plurality of main cylinders 50 located below bridge 18 and extending between the lower crosshead assembly 28 and the bottom of bridge 18 are actuated. One end of main cylinders 50 is braced against the bottom of stationary bridge 18 and the other end acts on lower crosshead assembly 28 to push the frame down with great force thereby squeezing and forging the metal ingot between dies 44 and 46.

Main cylinders 50 are larger and more powerful and there are more of them than there are return cylinders 38 because the forging press forces for shaping metal are far larger than the forces required for merely raising or lowering frame 24.

As stated before, FIG. 1 is schematically drawn and is not intended to show details of an actual forging press. Nevertheless, FIG. 1 does illustrate correctly that crosshead assemblies 26 and 28 are constructed of pluralities of upright plates 21 which are laminated together as shown. Similarly, the tie-rod assemblies 30 and 32 are likewise constructed of respective plates 23 which overlap one another as shown.

Referring now to FIG. 2, upper crosshead assembly 26 and lower crosshead assembly 28 are interconnected by a left tie-rod assembly 32 and right tie-rod assembly 30. The tie-rod assemblies on each side of a crosshead connect to respective end regions 52 by means of a yoke shaped coupling structure which is described in the present assignee's copending application U.S. Ser. No. 821,790. It is also possible to connect the tie-rod assembly to the crossheads with link pins as in prior art forging presses. Bridge 18 at the center of frame 24 is located at about ground level 14. Note too, return cylinders 38, main cylinders 50 and platens 42 and 40 which were previously described.

Upper and lower crosshead assemblies 26 and 28 are comprised of pluralities of laminated plates 21 (FIG. 1). The plates are reinforced and held together by bolts or ties 25 (FIG. 2) which extend through appropriate tie holes.

The focus of the present invention is on a novel tie and tie hole configuration for crosshead assemblies. However, the same concept is equally applicable for tie-rod assemblies.

Figure 3:
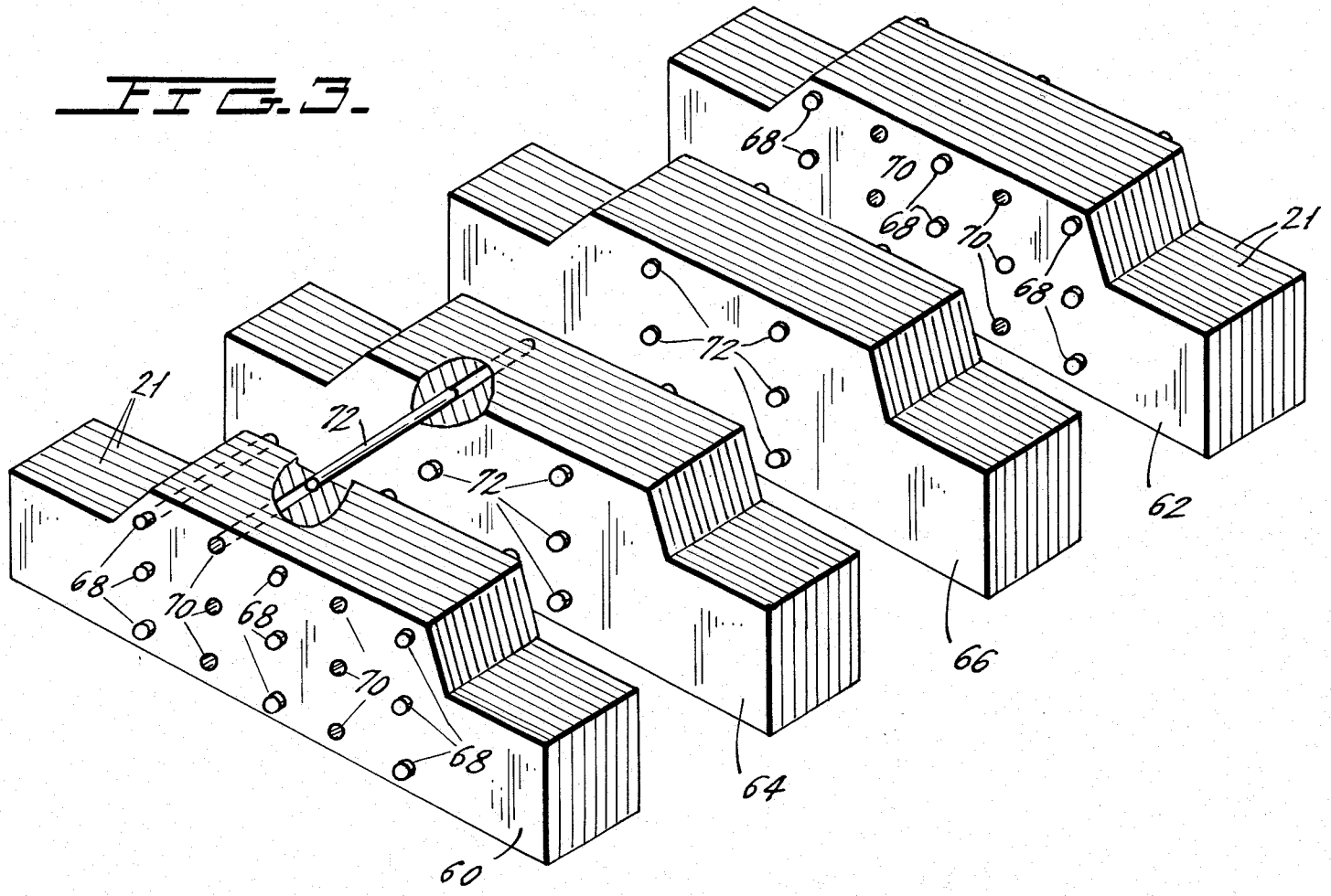
FIG. 3 is a first embodiment of the present invention.

A first embodiment of the present invention is illustrated in FIG. 3 and shows an upper crosshead assembly 26 which includes four crosshead sections including a first outer crosshead section 60, a second outer crosshead section 62 and two intermediate crosshead sections 64 and 66. Each section is made of a plurality (5 to 20) of individual plates 21 tied together across their thickness to form a single unit. The plates are tied together by link pins or ties 68. There may be as few as 5 and as many as 20 or more ties 68 arranged in several rows in each section. Preferably, 10 plates make up a given section, the overall width of a single section is 6–7 feet while the length of a tie is 9 feet so that approximately 1 foot of tie protrudes on either end of a section. The protruding section of the ties can be threaded for a knot or the like to secure the plates together.

The distance between crosshead sections is about 4–5 feet. Therefore, if and when the need arises to remove an individual crosshead plate, no problem is presented with respect to outer crosshead sections 60 and 62 because ties 68 holding them together can be withdrawn without hindrance. On the other hand middle sections 64 and 66 cannot be dismantled without first dismantling outer crosshead sections 60 and 62.

To solve this problem, outer crosshead sections 60 and 62 have additional, ordinarily unused, clearance holes 70. The ties in the intermediate crosshead sections are laterally offset from those in the outer crosshead sections so that the ties of the intermediate sections can be withdrawn by guiding them through clearance holes 70. A partially withdrawn tie 72 appears in FIG. 3.

Where there is only one intermediate crosshead section, the required number of clearance holes can be divided between the two outer crosshead sections 60 and 62 so that, for example, one half of the intermediate ties 68 can be withdrawn through one outer crosshead section while the remainder are withdrawn through the other.

Figure 4:
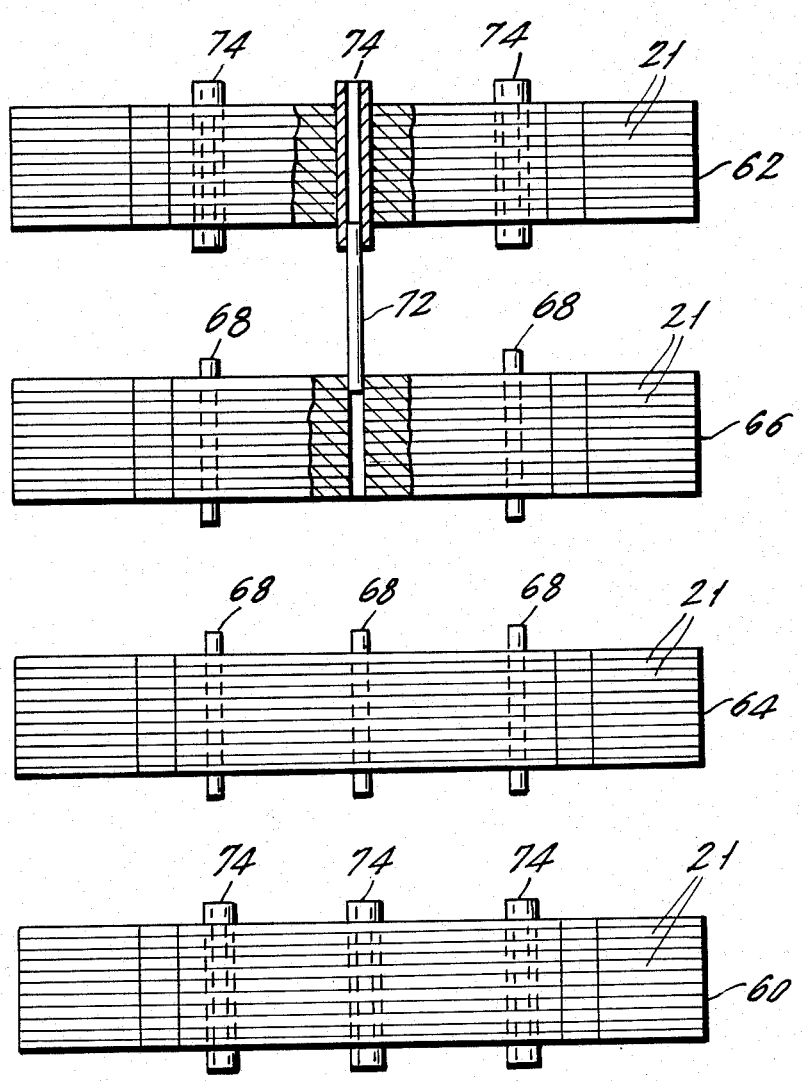
FIG. 4 is a second embodiment of the present invention.

A second embodiment of the present invention, illustrated in FIG. 4, differs from the first embodiment in that the ties 68 of both the outer crosshead section and the intermediate crosshead sections are axially aligned with one another. To permit withdrawal of ties 70 from the intermediate crosshead sections 64 and 66, modified tubular ties 74 preferably having cylindrical cross-section are used in the outer crosshead assemblies 60 and 62. The inner diameter of tubular ties 74 is sufficiently large to permit passage therethrough of the solid ties 72 which have smaller cross-sections and which are used in the intermediate crosshead sections. It is preferred to have a clearance of about one quarter to one half inches between the interior wall of the tubular ties 74 and the solid ties 68 of the intermediate crosshead sections. The foregoing arrangement permits easy removal and insertion of the intermediate ties without removal of the outer crosshead sections.

Although particular embodiments of the present invention were described above in relation to crosshead assemblies, the same concepts are equally applicable to tie-rod assemblies because they too are constructed of lamination of relatively flat elongated plates arranged in several sections.

Although the present invention is described in connection with a plurality of preferred embodiments thereof, many other variations, modifications and other uses will now become apparent to those skilled in the art. It is therefore preferred that the present invention be limited not by the specific embodiments disclosed herein but only by the appended claims.

What is claimed is:

1. An assembly for a frame of a forging press, said assembly comprising:

a plurality of sections mounted on said frame and in a parallel relationship, each of said sections including a plurality of generally flat plates arranged in overlapping relationship to one another;

a plurality of aligned tie holes through said plates; and a plurality of elongated ties disposed in and protruding from said tie holes for reinforcing and securing said plates of each section to one another, said plurality of sections including first and second outer sections and at least one intermediate section located between and spaced from said first and second outer sections, said tie holes in said at least one intermediate section being offset from said tie holes which are provided in at least one of said outer sections; and clearance holes located in at least one of said outer sections to permit ties used with said at least one intermediate section to be withdrawn by passage thereof through said clearance holes whereby removal of ties from said at least one intermediate section is enabled without dismantling or removal of any one of said outer sections.

2. An assembly in accordance with claim 1 in which said forging press is a 50–500 kiloton forging press.

3. An assembly as in claim 2 in which there are between 10 to 30 of said ties for each of said sections.

4. An assembly as in claim 2 whrein there is a single intermediate section and said clearance holes are provided in one of said outer sections.

5. An assembly as in claim 2 in which there is a single one of said at least one intermediate section and wherein a portion of said ties associated with said intermediate section are removable through said first outer cross section and the remainder of said ties are removable through said second outer section.

6. An assembly as in claim 2 in which said at least one intermediate section includes first and second intermediate sections and in which the ties associated with said first intermediate section are removable through said clearance holes provided in said first outer section and said ties provided in said second intermediate section are removable through said clearance hole provided in said second outer crosshead section.

7. An assembly as in claim 2 in which said assembly is a crosshead assembly, said plates being oriented vertically and wherein each one of said plurality of crosshead sections includes about 5–20 of said plates.

8. An assembly for a frame of a forging press, said assembly comprising:

a plurality of spaced sections mounted on said frame and in a parallel relationship, each of said sections including a plurality of generally flat plates arranged in overlapping relationship to one another;

a plurality of aligned tie holes through said plates, said tie holes located in any given one of said sections being axially aligned with corresponding ones of said tie holes in another section, said plurality of sections including first and second outer sections and at least one intermediate section, at least one of said first and second outer sections comprising a plurality of elongated tubular ties extending through and protruding from their respective tie holes;

said at least one intermediate section comprising respective elongated solid ties which extend through their respective tie holes;

said tubular ties of said first and second outer sections and said solid ties of said at least one intermediate section being dimensioned to enable said solid ties to pass through said tubular ties for easy removal thereof.

9. The crosshead assembly of claim 8 in which there is about a one quarter to one half inch clearance between said solid ties and the interior surface of said tubular ties when said solid ties are in said tubular ties.

10. An assembly in accordance with claim 8 in which said forging press is a 50–500 kiloton forging press.

11. An assembly as in claim 8 in which there are between 10 to 30 of said ties for each one of said sections.

12. An assembly as in claim 8 wherein there is a single intermediate section and said solid ties are removable through one of said outer sections.

13. An assembly as in claim 8 in which there is a single intermediate section and a portion of said ties associated with said intermediate section are removable through said first outer section and the remainder of said ties are removable through said second outer section.

14. An assembly as in claim 8 in which said at least one intermediate section includes first and second intermediate sections and in which said ties associated with said first intermediate section are removable through said first outer section and said ties provided in said second intermediate section are removable through said second outer section.

15. An assembly as in claim 8 in which said assembly is a crosshead assembly for the forging press.

* * * * *